US005664779A

United States Patent [19]

Soovajian, Jr.

[11] Patent Number: 5,664,779

[45] Date of Patent: Sep. 9, 1997

[54] MATHEMATICAL PUZZLE WITH PRIZE RELEASE MEANS

[76] Inventor: John Soovajian, Jr., 73 Magnolia St., Bergenfield, N.J. 07621

[21] Appl. No.: 705,948

[22] Filed: Aug. 30, 1996

[51] Int. Cl.[6] ..... A63F 9/06

[52] U.S. Cl. ..... 273/153 R; 273/156; 273/430

[58] Field of Search ..... 273/153 R, 156, 273/153 S, 429, 430, 431, 432; 434/198, 199, 206, 342, 332, 348, 404, 405, 406

[56] References Cited

U.S. PATENT DOCUMENTS

| | | | |
|---|---|---|---|
| 2,690,621 | 10/1954 | Dean | 273/430 |
| 3,216,558 | 11/1965 | Marsh | 273/153 S |
| 3,650,379 | 3/1972 | La Montagne | 273/156 |
| 4,389,194 | 6/1983 | Toll et al. | 434/332 |
| 4,989,872 | 2/1991 | Urrestarazu Borda | 273/153 R |
| 5,221,093 | 6/1993 | Adams | 273/429 |
| 5,310,184 | 5/1994 | Grist | 273/156 |
| 5,452,895 | 9/1995 | Ray | 273/153 S |

*Primary Examiner*—Steven B. Wong

[57] ABSTRACT

A mathematical puzzle including a first portion and a second portion. The second portion is removably couplable to the first portion. As such, the first portion and second portion define an interior space when coupled. Further provided is a puzzle mechanism with a puzzle preferably comprising an algebraic equation. Upon the solving of the puzzle, the puzzle mechanism is adapted to allow the separation of the first portion and the second portion thus releasing a prize situated within the interior space.

4 Claims, 3 Drawing Sheets

MATHEMATICAL PUZZLE WITH PRIZE RELEASE MEANS

BACKGROUND OF THE INVENTION

1. Field of the Invention

The present invention relates to a mathematical puzzle with prize release means and more particularly pertains to releasing a prize upon successfully solving an algebraic equation.

2. Description of the Prior Art

The use of puzzles Us known in the prior art. More specifically, puzzles heretofore devised and utilized for educational purposes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,715,605 to Fritzman; U.S. Pat. No. 4,889,340 to Greene; U.S. Pat. No. 5,074,562 to Green; and U.S. Pat. No. 5,205,558 to Wilson are provided as being of general interest.

In this respect, the mathematical puzzle with prize release means according to the present invention substantially departs from the conventional concepts and designs of the prior art, and in so doing provides an apparatus primarily developed for the purpose of releasing a prize upon successfully solving an algebraic equation.

Therefore, it can be appreciated that there exists a continuing need for a new and improved mathematical puzzle with prize release means which can be used for releasing a prize upon successfully solving an algebraic equation. In this regard, the present invention substantially fulfills this need.

SUMMARY OF THE INVENTION

In view of the foregoing disadvantages inherent in the known types of puzzles now present in the prior art, the present invention provides an improved mathematical puzzle with prize release means. As such, the general purpose of the present invention, which will be described subsequently in greater detail, is to provide a new and improved mathematical puzzle with prize release means which has all the advantages of the prior art and none of the disadvantages.

To attain this, the present invention essentially comprises a lower half sphere with a planar circular top face and a spherical bottom face. As best shown in FIG. 6, the lower half sphere has a spherical recess centrally formed on the top face thereof. Formed about a periphery of the spherical recess on the top face of the lower half sphere is an annular geared track. An annular cut out is formed on the top face of the lower half sphere adjacent to a periphery thereof. As best shown in FIG. 4, an outwardly extending horizontally oriented lip is integrally formed on an entire inboard edge of the cut out. Further provided is an upper half sphere having a planar bottom face and a spherical top face with a closed interior space defined therebetween. The upper half sphere includes a spherical recess centrally formed on the bottom face thereof. Such recess preferably has a diameter equal to that of the recess of the lower half sphere. A post, shown in FIG. 3, is fixedly coupled between an apex of the upper half sphere and an apex of the recess of the upper half sphere within the interior space thereof. Also included is a plurality of linearly aligned buttons residing on the upper half sphere within a plane including the apex of the upper half sphere.

Such plane is further situated perpendicular with respect to the bottom face of the upper half sphere. Each of the buttons has a first unbiased orientation wherein the button substantially resides exterior of upper half sphere. A second biased orientation of each button is constituted by the button protruding within the interior space upon the depression thereof. For allowing a user to view within the interior space, a window is formed substantially within the above mentioned plane below the buttons. As shown in FIG. 1, each button has indicia representative of a number imprinted thereon. For securing the bottom face of the upper half sphere and the top face of the lower half sphere together, a locking mechanism is included with a locking tab. Such locking tab has a vertical portion coupled to and depending from the bottom face of the upper half sphere adjacent a periphery thereof. A first angled portion is integrally formed with a bottom end of the vertical portion and further extends both upwardly and radially outward therefrom. Also formed with the bottom end of the vertical portion is a second angled portion extending both upwardly and radially inwardly, whereby upon abutting the bottom face of the upper half sphere and the top face of the lower half sphere, the second angled portion is adapted to secure to the lip of the annular cut out of the lower half sphere. The locking mechanism further includes a release button positioned on the bottom face of the upper half sphere adjacent the periphery thereof. In use, the button is adapted to engage the first angled portion and further force it radially outward upon the depression thereof thereby disengaging the second angled portion and the lip of the lower half sphere. Finally, a rotatable equation assembly, as best shown in FIG. 3, is included. The rotatable equation assembly includes a central rod rotatably coupled to the post of the upper half sphere. Associated therewith is a horizontally oriented first gear fixed to a lower end of the central post and adapted to rotate coincidentally therewith. Further included is a second gear rotatably and tangentially coupled to the recess of the upper half sphere within the interior space thereof. The second gear is adapted to rotate coincidentally with the first gear. With reference still to FIG. 3, a vertically oriented third gear is rotatably coupled to the recess of the upper half sphere within the interior space thereof. Such third gear is adapted to rotate coincidentally with the first gear and the second gear. Additionally, the third gear is adapted to engage the annular geared track of the lower half sphere when the bottom face of the upper half sphere and the top face of the lower half sphere are connected. By this structure, the central post is adapted to rotate upon the rotation of the lower half sphere with respect to the upper half sphere. The rotatable equation assembly further includes a multiplicity of arcuate arms. Each arm has a first end hingably coupled to an upper end of the central rod and extends radially therefrom. It should be noted that each arm is located proximal to an inner surface of the upper half sphere. Printed on each arm is indicia visible through the window. Such indicia is representative of an algebraic equation. At least one protrusion is formed on each arm adjacent at least one of the buttons with indicia representative of a correct answer to the equation. Upon the depression of a correct button, the corresponding arm depresses the locking button, thereby disengaging the locking mechanism and, in turn, allowing access to the spherical recesses thus releasing a prize. To provide another equation, another arm is conveniently situated adjacent the buttons upon the rotation of the lower half sphere with respect to the upper half sphere.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mathematical puzzle with prize release means which has all the advantages of the prior art puzzles and none of the disadvantages.

It is another object of the present invention to provide a new and improved mathematical puzzle with prize release means which may be easily and efficiently manufactured and marketed.

It is a further object of the present invention to provide a new and improved mathematical puzzle with prize release means which is of a durable and reliable construction.

An even further object of the present invention is to provide a new and improved mathematical puzzle with prize release means which is susceptible of a low cost of manufacture with regard to both materials and labor, and which accordingly is then susceptible of low prices of sale to the consuming public, thereby making such mathematical puzzle with prize release means economically available to the buying public.

Still yet another object of the present invention is to provide a new and improved mathematical puzzle with prize release means which provides in the apparatuses and methods of the prior art some of the advantages thereof, while simultaneously overcoming some of the advantages normally associated therewith.

Still another object of the present invention is to release a prize upon successfully solving an algebraic equation.

Lastly, it is an object of the present invention to provide a new and improved mathematical puzzle including a first portion and a second portion. The second portion is removably couplable to the first portion. As such, the first portion and second portion define an interior space when coupled. Further provided is a puzzle mechanism with a puzzle preferably comprising an algebraic equation. Upon the solving of the puzzle, the puzzle mechanism is adapted to allow the separation of the first portion and the second portion thus releasing a prize situated within the interior space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
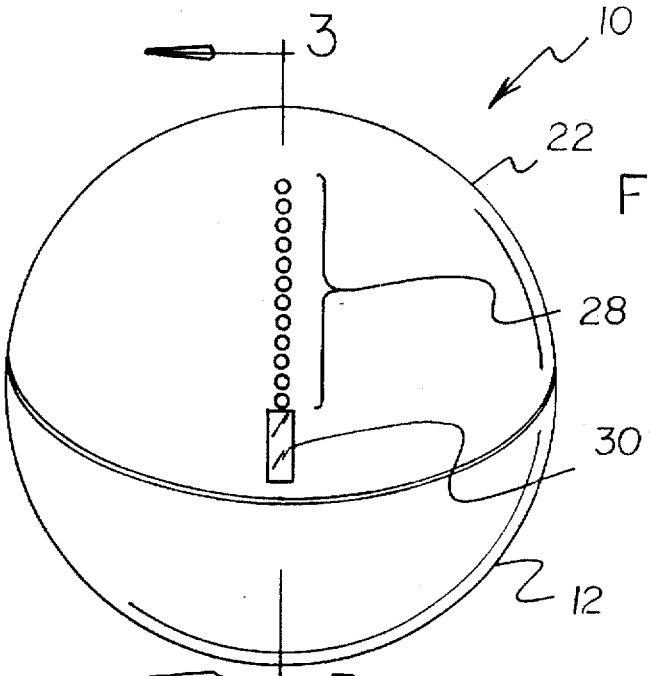
FIG. 1 is a perspective illustration of the preferred embodiment of the mathematical puzzle with prize release means constructed in accordance with the principles of the present invention.
Figure 2:
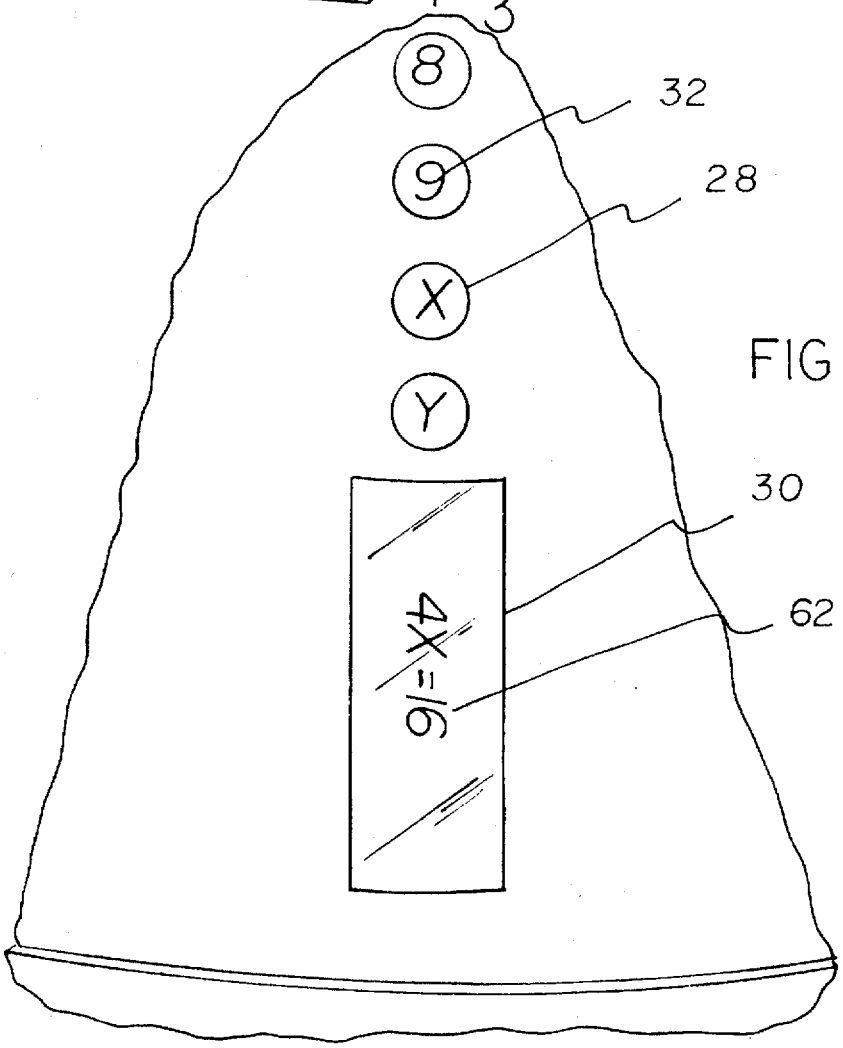
FIG. 2 is an exploded view of the buttons and window of the present invention.

With reference now to the drawings, and in particular to FIG. 1 thereof, a new and improved mathematical puzzle with prize release means embodying the principles and concepts of the present invention and generally designated by the reference numeral 10 will be described.

The present invention, the new and improved mathematical puzzle with prize release means, is comprised of a plurality of components. Such components in their broadest context include an upper half sphere, a lower half sphere, a locking mechanism, and a rotatable equation assembly. Such components are individually configured and correlated with respect to each other so as to attain the desired objective.

Figure 4:
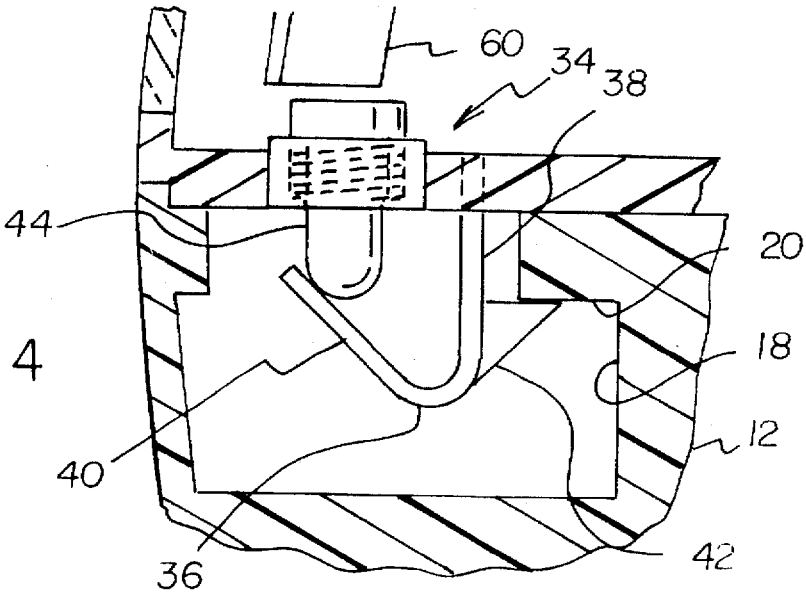
FIG. 4 is a close-up view of the locking mechanism shown in FIG. 3.
Figure 5:
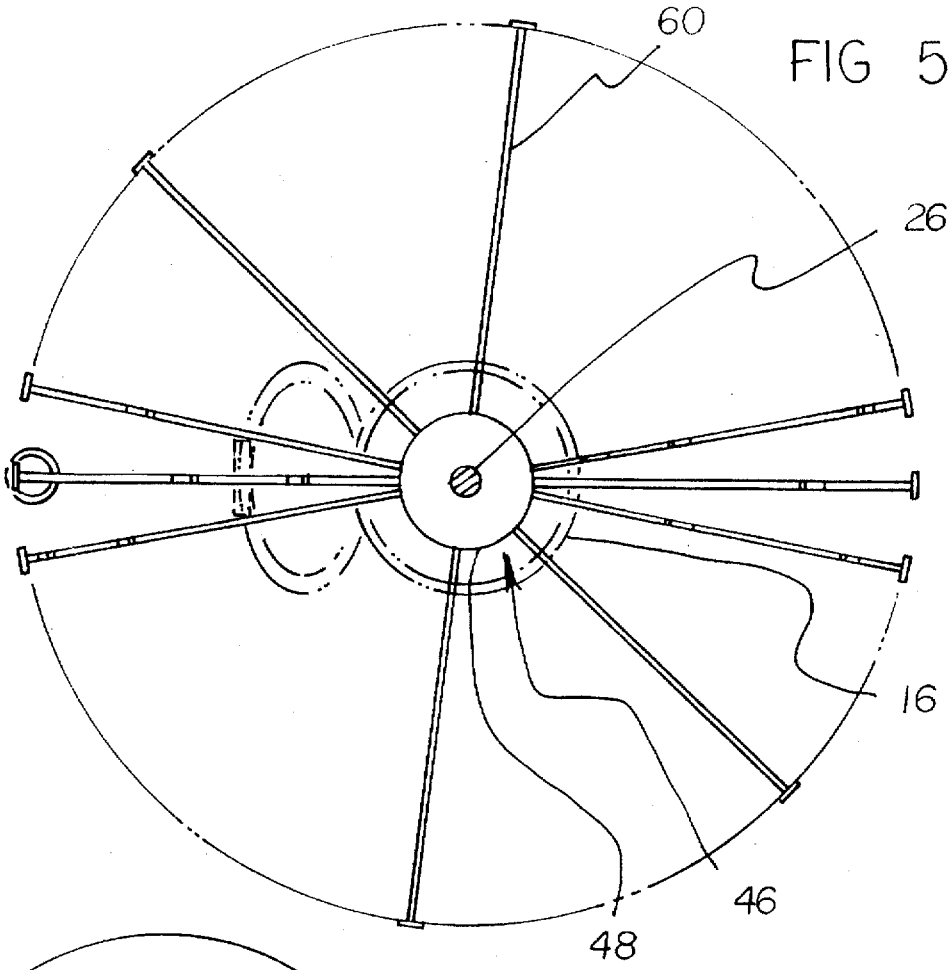
FIG. 5 is a top view of the rotatable equation assembly situated within the upper half sphere.
Figure 6:
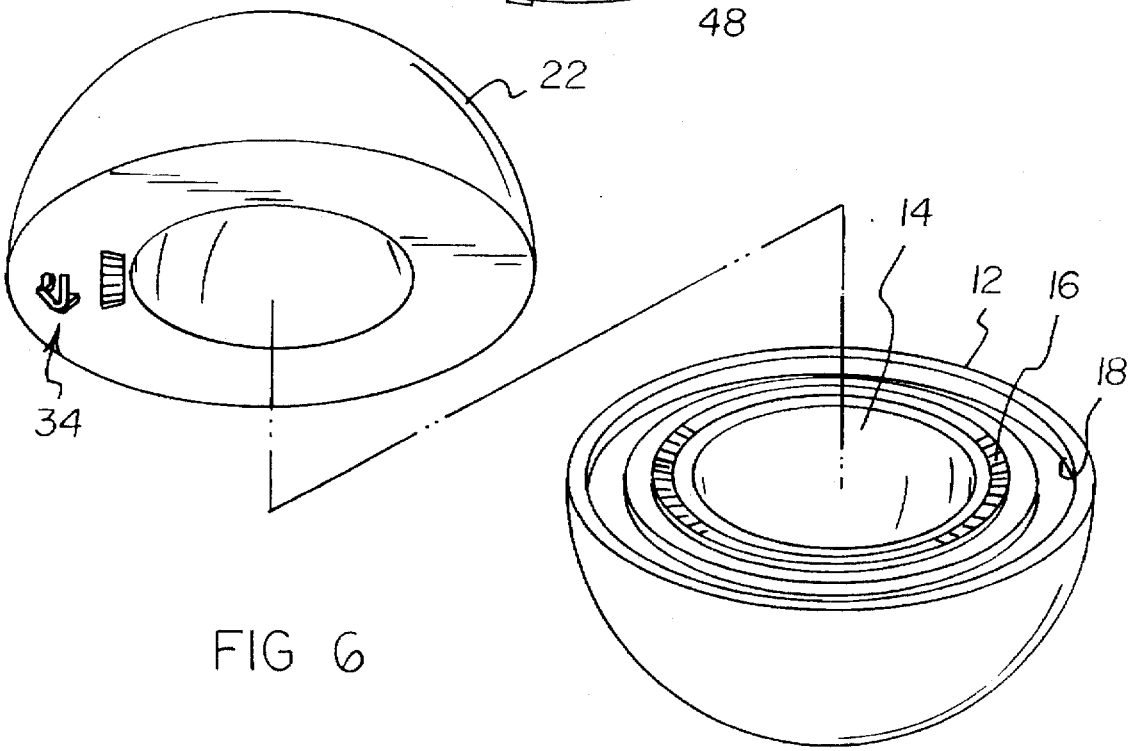
FIG. 6 is a perspective view of the present invention in an disassembled orientation.

More specifically, at will be noted that the system 10 of the present invention includes a lower half sphere 12 with a planar circular top face and a spherical bottom face. As best shown in FIG. 6, the lower half sphere has a spherical recess 14 centrally formed on the top face thereof. Formed about a periphery of the spherical recess on the top face of the lower half sphere is an annular geared track 16. An annular cut out 18 is formed on the top face of the lower half sphere adjacent to a periphery thereof. As best shown in FIG. 4, an outwardly extending horizontally oriented lip 20 is integrally formed on an entire inboard edge of the cut out.

Figure 3:
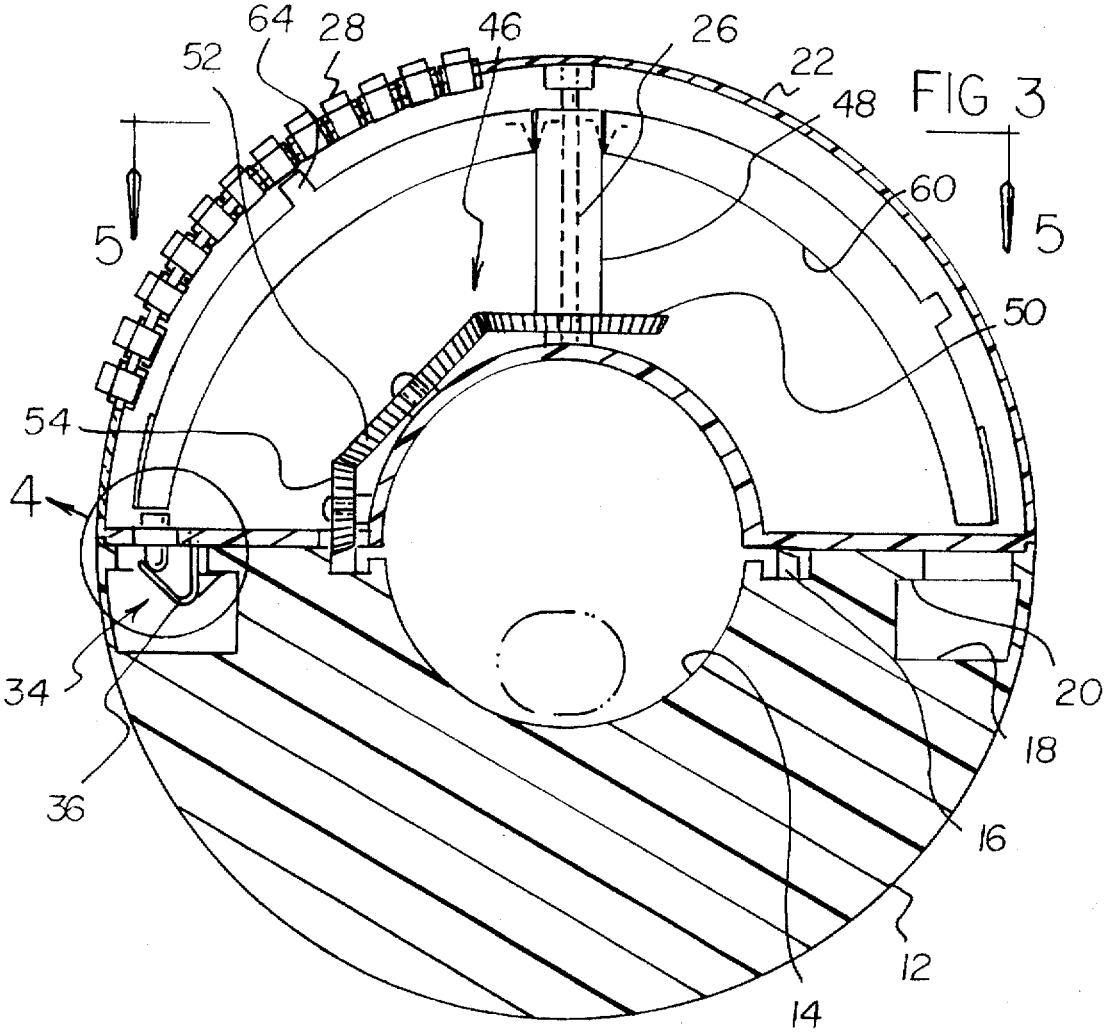
FIG. 3 is a cross-sectional view of the present invention taken along lines 3—3 shown in FIG. 1.

Further provided is an upper half sphere 22 having a planar bottom face and a spherical top face with a closed interior space defined therebetween. The upper half sphere includes a spherical recess 24 centrally formed on the bottom face thereof. Such recess preferably has a diameter equal to that of the recess of the lower half sphere. A post 26, shown in FIG. 3, is fixedly coupled between an apex of the upper half sphere and an apex of the recess of the upper half sphere within the interior space thereof. Also included is a plurality of linearly aligned buttons 28 residing on the upper half sphere within a plane including the apex of the upper half sphere. Such plane is further perpendicular with respect to the bottom face of the upper half sphere. Each of the buttons has a first unbiased orientation wherein the button substantially resides exterior of upper half sphere. A second biased orientation of each button is constituted by the button protruding within the interior space upon the depression thereof. For allowing a user to view within the interior space, a window is 30 formed substantially within the above mentioned plane below the buttons. As shown in FIG. 1, each button has indicia 32 representative of a number imprinted thereon.

For securing the bottom face of the upper half sphere and the top face of the lower half sphere together, a locking mechanism 34 is included with a resilient locking tab 36. Such locking tab has a vertical portion 38 coupled to and depending from the bottom face of the upper half sphere adjacent a periphery thereof. A first angled portion 40 is integrally formed with a bottom end of the vertical portion and further extends both upwardly and radially outward therefrom. Also formed with the bottom end of the vertical portion is a second angled portion 42 extending both upwardly and radially inwardly, whereby upon abutting the bottom face of the upper half sphere and the top face of the lower half sphere, the second angled portion is adapted to secure to the lip of the annular cut out of the lower half sphere. As such, when the sphere halves are locked together, the angled portions reside in the annular cut out and are adapted to slide freely therein thus allowing rotation of the sphere halves with respect to each other. The locking mechanism further includes a release button 44 positioned on the bottom face of the upper half sphere adjacent the periphery thereof. In use, upon the depression thereof, the button is adapted to engage the first angled portion and further force it radially outward thereby disengaging the second angled portion and the lip of the lower half sphere. Preferably, the lower half sphere is of a greater weight than the upper half sphere so as to maintain the upper half sphere upright when the sphere halves are coupled.

Finally, a rotatable equation assembly 46, as best shown in FIG. 3, is included. The rotatable equation assembly includes a central rod 48 rotatably coupled to the post of the upper half sphere. Associated therewith is a horizontally oriented first gear 50 fixed to a lower end of the central post and adapted to rotate coincidentally with the post. Further included is a second gear 52 rotatably and tangentially coupled to the recess of the upper half sphere within the interior space thereof. The second gear is adapted to rotate coincidentally with the first gear. With reference still to FIG. 3, a vertically oriented third gear 54 is rotatably coupled to the recess of the upper half sphere within the interior space thereof. Such third gear is adapted to rotate coincidentally with the first gear and the second gear. Additionally, the third gear is adapted to engage the annular geared track of the lower half sphere when the bottom face of the upper half sphere and the top face of the lower half sphere are connected. By this structure, the central post is adapted to rotate upon the rotation of the lower half sphere with respect to the upper half sphere. It should be noted that the third gear extends beyond the bottom face of the upper half sphere only enough to engage the annular geared track.

The rotatable equation assembly further includes a multiplicity of arcuate arms 60. Each arm has a first end hingably coupled to an upper end of the central rod and extends radially therefrom. It should be noted that each arm is located proximal to an inner surface of the upper half sphere. Printed on each arm is indicia 62 visible through the window. Such indicia is representative of an algebraic equation. At least one protrusion 64 is formed on each arm adjacent at least one of the buttons with indicia representative of a correct answer to the equation. Upon the depression of a correct button, the corresponding arm depresses the locking button, thereby disengaging the locking mechanism and, in turn, allowing access to the spherical recesses thus releasing a prize. To reuse the present invention, the upper half sphere and the lower half sphere are again coupled. Also, in order to provide another equation, another arm is conveniently situated adjacent the buttons upon the rotation of the lower half sphere with respect to the upper half sphere.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mathematical puzzle with prize release means comprising, in combination:

a lower half sphere with a planar circular top face and a spherical bottom face, the lower half sphere having a spherical recess centrally formed on the top face thereof, an annular geared track formed about a periphery of the spherical recess on the top face of the lower half sphere, and an annular cut out formed on the top face of the lower half sphere adjacent to a periphery thereof with an outwardly extending horizontally oriented lip integrally formed on an entire inboard edge of the cut out;

an upper half sphere having a planar bottom face and a spherical top face with a closed interior space defined therebetween, the upper half sphere including a spherical recess centrally formed on the bottom face thereof with a diameter equal to that of the recess of the lower half sphere, a post fixedly coupled between an apex of the upper half sphere and an apex of the recess of the upper half sphere within the interior space thereof, a plurality of linearly aligned buttons residing radially within a plane including the apex of the upper half sphere and with the plane further situated perpendicular with respect to the bottom face of the upper half sphere with the buttons having a first unbiased orientation wherein the button substantially resides exterior of upper half sphere and a second biased orientation wherein the button protrudes within the interior space upon the depression thereof, and a window formed substantially within the above mentioned plane below the buttons for allowing a user to view within the interior space, wherein each button has indicia representative of a number imprinted thereon;

a locking mechanism for maintaining the bottom face of the upper half sphere and the top face of the lower half sphere connected, the locking mechanism including a locking tab with a vertical portion coupled to and depending from the bottom face of the upper half sphere adjacent a periphery thereof, a first angled portion integrally formed with a bottom end of the vertical portion and further extending both upwardly and radially outward therefrom, and a second angled portion integrally formed with the bottom end of the vertical portion and further extending both upwardly and radially inward therefrom whereby upon abutting the bottom face of the upper half sphere and the top face of the lower half sphere, the second angled portion is adapted to secure to the lip of the annular cut out of the lower half sphere thus locking the sphere halves together, the locking mechanism further including a release button positioned on the bottom face of the upper half sphere adjacent the periphery thereof with the button adapted to engage the first angled portion and further force it radially outward upon the depression thereof thereby disengaging the second angled portion and the lip of the lower half sphere; and a rotatable equation assembly including a central rod rotatably coupled to the post of the upper half sphere with a horizontally oriented first gear fixed to a lower end of the central post and adapted to rotate coincidentally therewith, a second gear rotatably and tangentially coupled to the recess of the upper half sphere within the interior space thereof and adapted to rotate coincidentally with the first gear, a vertically oriented third gear rotatably coupled to the recess of the upper half sphere within the interior space thereof with the third gear adapted to rotate coincidentally with the first gear and the second gear and further adapted to engage the annular geared track of the lower half sphere when the bottom face of the upper half sphere and the top face of the lower half sphere are connected, whereby the central post is adapted to rotate upon the rotation of the lower half sphere with respect to the upper half sphere, the rotatable equation assembly further including a multiplicity of arcuate arms each having a first end hingably coupled to an upper end of the central rod and extending radially therefrom proximal to an inner surface of the upper half sphere, each arm including indicia printed thereon visible through the window representative of an equation and at least one protrusion formed on the arm adjacent at least one of the buttons with indicia representative of a correct answer to the equation, whereby upon the depression of a correct button, the corresponding arm depresses the locking button thereby disengaging the locking mechanism and allowing access to the spherical recesses thus releasing a prize and further another arm is situated adjacent the buttons upon the rotation of the lower half sphere with respect to the upper half sphere.

2. A puzzle with prize release means comprising:

a first portion formed of an upper half sphere;

an second portion formed of a lower half sphere and removably and rotatably couplable with the first portion, whereby the first portion and second portion define an interior space when coupled; and puzzle means adapted to separate the first portion and the second portion thus releasing a prize situated within the interior space upon the solving of the puzzle;

gear means situated within the interior space and adapted to effect the displaying of various puzzles upon the rotation of the first portion with respect to the second portion.

3. A mathematical puzzle with prize release means as set forth in claim 2 wherein the puzzle means comprises a plurality of algebraic equations.

4. A puzzle with prize release means comprising:

a first portion formed of an upper half sphere;

an second portion formed of a lower half sphere removably couplable with the first portion, whereby the first portion and second portion define an interior space when coupled; and puzzle means adapted to separate the first portion and the second portion thus releasing a prize situated within the interior space upon the solving of the puzzle;

locking means for maintaining the upper half sphere and the lower half sphere connected, the locking mechanism including a locking tab with a vertical portion coupled to and depending from a bottom face of the upper half sphere, a first angled portion integrally formed with a bottom end of the vertical portion and further extending both upwardly and radially outward therefrom, and a second angled portion integrally formed with the bottom end of the vertical portion and further extending both upwardly and radially inward therefrom whereby upon abutting the bottom face of the upper half sphere and a top face of the lower half sphere, the second angled portion adapted to secure to a lip of an annular cut out of the lower half sphere thus locking the sphere halves together, the locking mechanism further including a release button adapted to engage the first angled portion and further effect the biasing thereof upon the depression of the release button thereby disengaging the second angled portion and the lip of the lower half sphere, whereby the release button is adapted to be depressed upon the selection of a correct answer.

* * * * *